US005875929A

United States Patent [19]

Nguyen

[11] Patent Number: 5,875,929

[45] Date of Patent: Mar. 2, 1999

[54] TOOTHPASTE DISPENSING APPARATUS

[76] Inventor: Dung T. Nguyen, 5909 S. Oak Dr., Marrero, La. 70072

[21] Appl. No.: 13,988

[22] Filed: Jan. 27, 1998

[51] Int. Cl.[6] ..... B65D 35/28

[52] U.S. Cl. ..... 222/102; 222/333

[58] Field of Search ..... 222/102, 333

[56] References Cited

U.S. PATENT DOCUMENTS

| | | | |
|---|---|---|---|
| 3,151,616 | 10/1964 | Selfon | 222/102 X |
| 3,313,454 | 4/1967 | Welsh et al. | 222/102 |
| 3,581,943 | 6/1971 | Koenigshof | 222/102 |
| 3,860,147 | 1/1975 | Vessio et al. | 222/102 X |
| 4,010,873 | 3/1977 | Mardirossian | 222/101 |
| 4,125,206 | 11/1978 | Wilson | 222/101 |
| 4,234,104 | 11/1980 | Apuzzo, Jr. et al. | 222/94 |
| 4,403,714 | 9/1983 | Kane | 222/101 |
| 4,448,330 | 5/1984 | Roux | 222/101 |
| 5,203,473 | 4/1993 | Willey | 222/94 |
| 5,215,218 | 6/1993 | Choi | 222/102 |
| 5,441,172 | 8/1995 | Yu | 222/102 X |

FOREIGN PATENT DOCUMENTS

| | | | |
|---|---|---|---|
| 2415584 | 9/1979 | France | 222/102 |
| 2443975 | 8/1980 | France | 222/102 |
| 3904143 | 8/1990 | Germany | 222/102 |
| 8403474 | 7/1986 | Netherlands | 222/102 |

*Primary Examiner*—Kevin P. Shaver
*Attorney, Agent, or Firm*—Joseph N. Breaux

[57] ABSTRACT

A toothpaste dispensing apparatus that provides a mechanism for efficiently and selectively squeezing the contents from a toothpaste tube. The apparatus includes a tube compressing assembly with a pair of reversible motorized opposing rollers which squeeze a collapsible toothpaste tube displacing the tube's contents to a dispensing port. The apparatus is easily loaded with a new tube and effectively compresses the tube without premature buckling of the tube and without the need of securing the crimped end of the tube.

1 Claim, 2 Drawing Sheets

TOOTHPASTE DISPENSING APPARATUS

TECHNICAL FIELD

The present invention relates to a device for extracting contents from a collapsible tube and more particularly to a motorized device for efficiently and incrementally extracting toothpaste from a collapsible toothpaste tube.

BACKGROUND ART

There are numerous devices which have been developed providing an improved means of extracting toothpaste from collapsible toothpaste tubes. These devices although useful do not provide an apparatus which is easily loaded with a new tube of toothpaste, easily constructed using plastic molding techniques, and provide an apparatus which uniformly compresses the toothpaste tube without buckling the full end of the tube. The present apparatus provides a toothpaste dispensing device which is easily and quickly loaded with a new tube of toothpaste, while the paste is displaced from the tube using a compressing assembly comprising a motorized pair of opposing rollers which are aligned to incrementally track longitudinally up the tube compressing paste from the tube through a cap dispensing port.

The prior devices which utilize rollers for compressing a tube to displace contents require the tube end to be secured to prevent the end of the tube from trailing the rollers. While devices with rollers which incrementally move toward the full end of the tube, which do not have the compressed end secured, cause the full end of the tube to buckle prior to roller compression. The present device overcomes the problems associated with prior devices by providing a motorized opposing roller assembly. The rollers have frictional tube engagement surfaces providing positive roller movement as the rollers compress the tube. Longitudinal movement of the rollers along the tube is not motorized, however roller rotational movement is motorized and causes longitudinal roller movement as the frictional rollers surfaces engage the tube surface, thus buckling of the full end of the tube is prevented and it is not necessary to secure the compressed end.

Appuzo, U.S. Pat. No. 4,234,104 provides a motorized toothpaste dispenser with a pair of opposing rollers which are forced over the tube by vertical threaded shafts. Roller rotation is not engaged with a drive motor, but roller longitudinal movement is motorized. The inventor has found that motorizing longitudinal movement of the rollers, rather than motorizing roller rotation, causes the full end of the tube to prematurely buckle if the compressed end of the tube is not secured.

Wilson, U.S. Pat. No. 4,125,206 provides a hand operated toothpaste dispenser with a roller which is moved the longitudinal length of the tube by rotation of a threaded shaft. This device does not result in premature buckle of the full end of the tube because the end of the tube is secured in place by a screw clip. The extra step of attaching the end of the tube is undesirable and time consuming.

Kane, U.S. Pat. No. 4,403,714 provides a motorized toothpaste dispenser similar to the Wilson device, but being motorized and without tube end securing clip. Tube buckling as described above is experienced while also considerable time is required for changing tubes.

The present invention also provides a design which includes very few moving parts and the majority of the device can be constructed using conventional plastic molding techniques.

GENERAL SUMMARY DISCUSSION OF INVENTION

It is an object of the present invention to provide a toothpaste dispenser which will automatically and incrementally dispense toothpaste from a toothpaste tube by compressing the tube between rollers which are controlled by a drive motor.

It is a further object of the invention to provide a toothpaste dispenser where empty tubes are easily replaced by removal of a dispensing cap and replacement with a new tube is easily and quickly facilitated.

The inventor has found that these problems and others have been overcome by the present toothpaste dispensing device which includes a motorized roller assembly which is aligned to track longitudinally up the tube, while the motorized rollers have frictional tube engagement surfaces for positive engagement with the tube outer surface, while said roller rotation causes the roller assembly to move longitudinally up the tube, the roller assembly is contained within a housing which provides roller assembly tracks to maintain perpendicular roller alignment with the tube longitudinal axis, while also providing a housing mounting means, a motor actuation switch and power supply are also contained within the housing.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
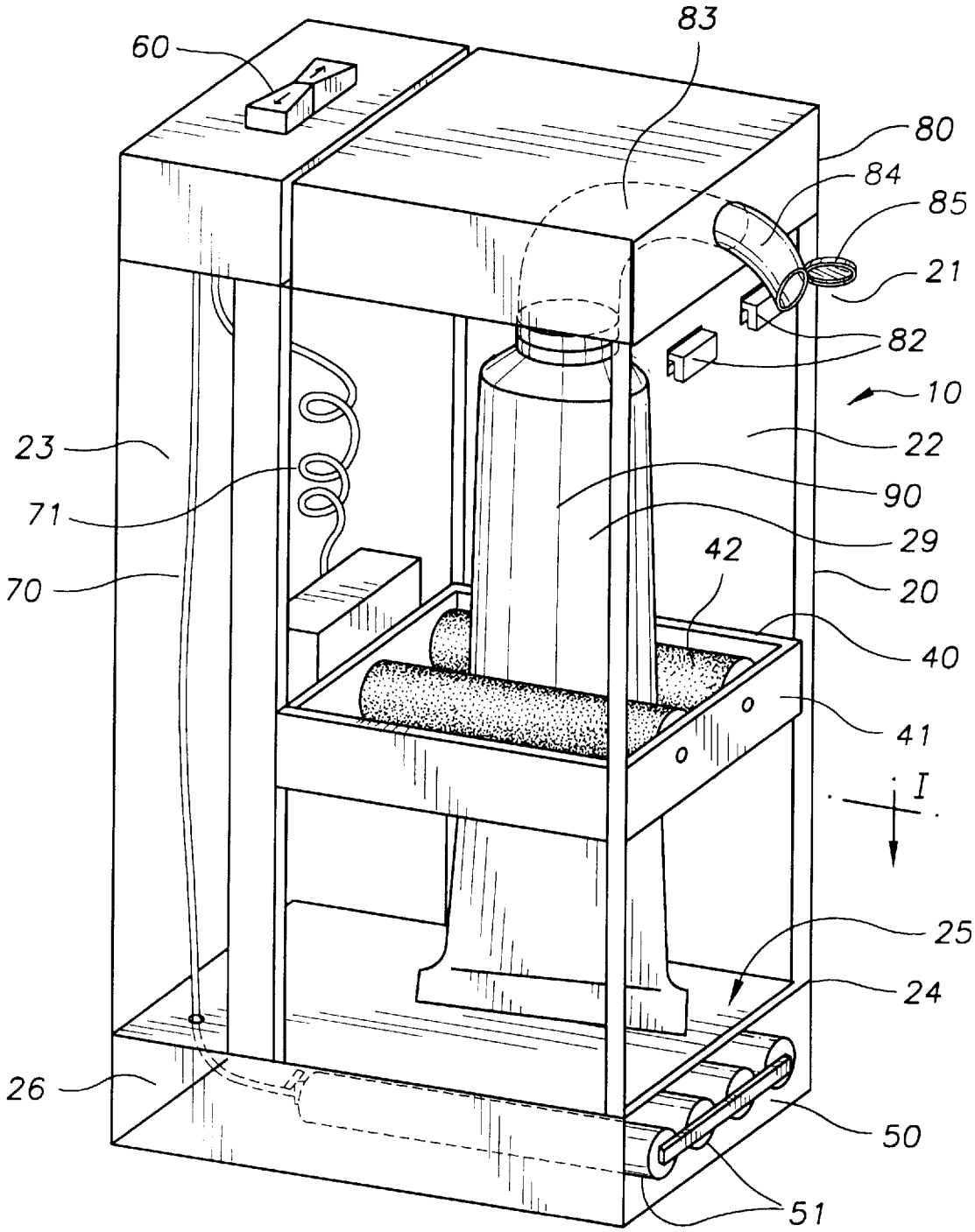
FIG. 1 is a perspective view of the apparatus, illustrating a toothpaste tube mounted within the housing and between the compressing motorized rollers.
Figure 2:
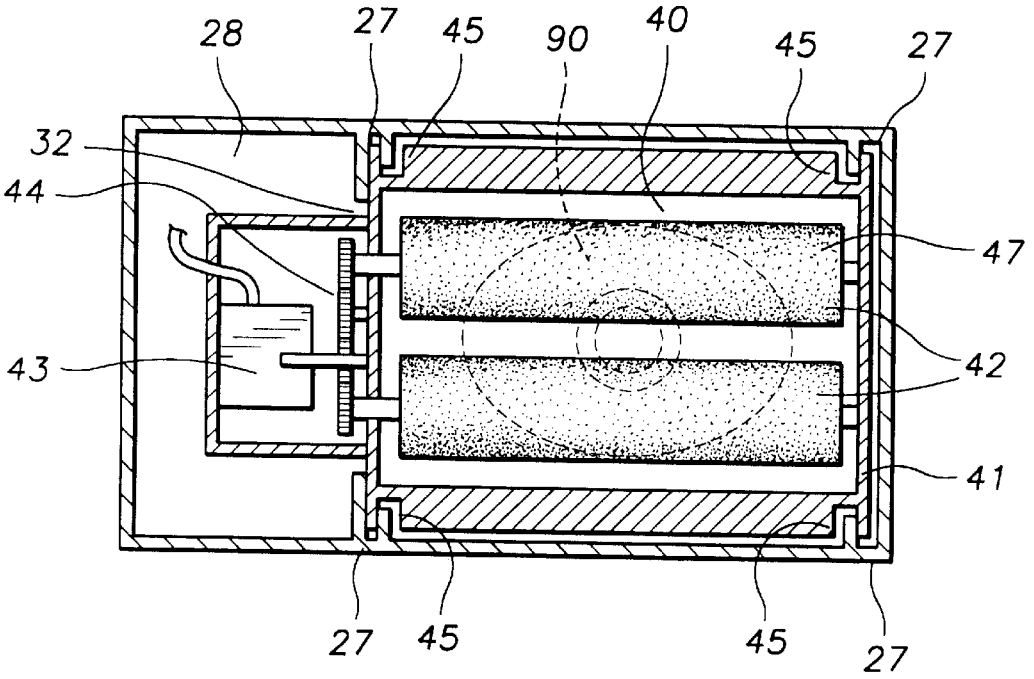
FIG. 2 is a cross section of the motorized roller assemble within the housing taken along axis I of FIG. 1.
Figure 3:
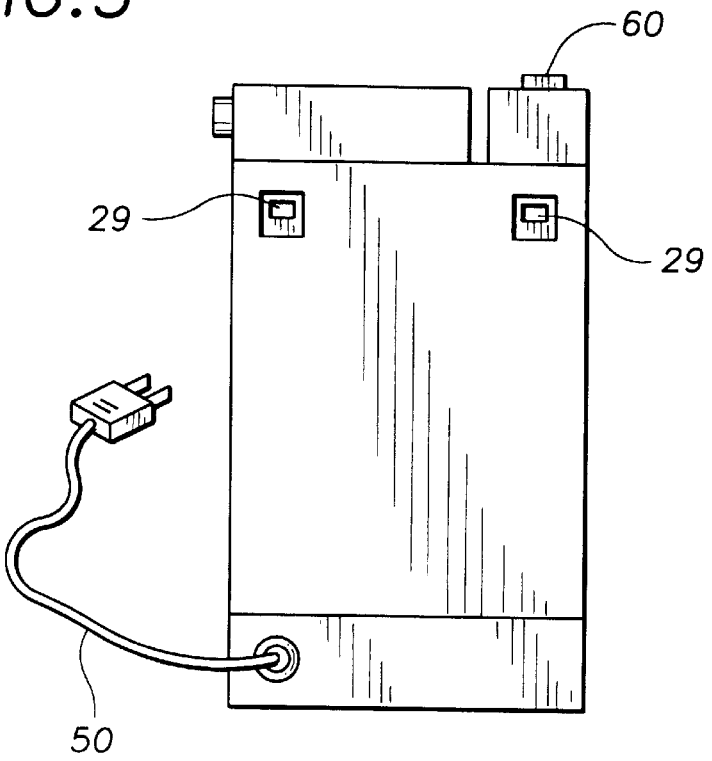
FIG. 3 is a back view of the dispensing apparatus.

The toothpaste dispensing apparatus 10 is illustrated in detail in FIG. 1 and generally comprises a housing 20, motorized roller compressing assembly 40, a power supply 50, activation switch 60, wiring 70, and dispensing cap 80. The housing 20 is generally rectangular and about ten inches high, three inches long and about two inches wide, and constructed of conventional molding techniques of a durable polymer such as ABS, styrene, polypropylene, polyethylene, polycarbonate or other suitable polymer. The housing has an interior roller assembly compartment 22, and a wiring compartment 23 which are open at the top end of the housing 21. The bottom end of the housing 24 is fitted with a floor 25, below the floor 25 is a power supply compartment 26 which may be molded from the same part as the remainder of the housing. The roller assembly compartment 22 forms a substantially square cylinder with tracks 27 in each corner for receiving the roller assembly 40. The housing 20 cross section is illustrate in FIG. 2 showing the tracks 27 positioned in the roller assembly compartment 22. The tracks 27 may be of any configuration which allows the roller assembly 40 to freely slide within the housing from the housing top end 21 to the housing bottom end 24 and are most preferably designed to be molded as a continuous part of the housing. The housing 20 also has a wiring compartment 28 which provides a location for placement of wiring 70 to the drive motor 43, power supply 50 and the activation switch 60 which is also molded as part of the housing. The housing roller compartment 22 and the housing wiring compartment 28 are separated by a longitudinal aperture 32 which extends from the housing top end 21 to the housing bottom end 24 which allows the longitudinal movement of the roller assemble 40 along with the drive motor 43 within the housing. The housing may also be equipped with a clear front panel 29 for viewing the tube within the housing.

Motorized roller compressing assembly 40 includes a frame work 41, a pair of opposing rollers 42 mounted within the frame 41, a drive motor 43 and gearing 44 coupling the drive motor to the rollers 42. The frame 41 is dimensioned to fit within the housing roller compartment 22, and has corner grooves 45 which match the tracks 27 within the housing. The tracks 27 align the roller assembly within the housing roller compartment 22 and maintain the rollers 42 in a substantially perpendicular position to the tube 90 and the tracks 27. The rollers 42 are mounted on the frame 41 so that a space 46 is formed between the rollers which space 46 should be slightly wider than the thickness of a compressed tube of toothpaste. Rollers 42 most preferably have frictional surfaces 47, such as surface knurling, a surface abrasive material, or other surface treatment which provides for roller traction on the surface of a toothpaste tube outer surface.

Power supply 50 as illustrated includes four AA batteries 51, other power sources such as AU or rechargeable battery packs may be employed without deviating from the intent of the invention. Activation switch 60 is mounter to a switch cap 61 at the top of the housing 21. The switch 60 may be a toggle switch, rocker switch, or slide switch as long as the switch is equipped with forward and reverse positions. The circuitry should provide for an ability to reverse the drive motor direction by use of the switch 60. The switch cap 61 contains the activation switch 60 wiring and other circuitry as well as providing a cap for the wiring housing compartment 23. Wiring 71 to the drive motor must be flexible as illustrated to allow the roller assembly to travel freely within the housing.

Dispensing cap 80 is positioned on the top end of the housing 21 and serves as a mounting means for the tube of toothpaste 90 which is screwed to a female dispensing cap threaded portion 81. The dispensing cap 80 is attached to the housing top 21 by plastic tangs 82 which are biased to a locking position. Other means may also be employed to secure the dispensing cap 80 such as clips or screws. A toothpaste delivery channel 83 travels from the threaded portion 81 through the dispensing cap to a dispensing port 84, so that toothpaste is easily accessible to the user. The dispensing port is also equipped with a dispensing port cover 85 which protects the toothpaste when not in use.

The apparatus may be attached to wall or other area using mounting brackets 29 which are molded into the housing back wall 30.

It can be seen from the preceding description that operation of the apparatus is first carried out by loading a new tube of toothpaste into the apparatus housing and between the roller assembly. The dispensing cap is removed by depressing plastic tangs and lifting the cap from the housing. The tube is screwed to the dispensing cap and the crimped end of the tube is then placed into the housing interior and between the opposed rollers. At this step the rollers can be in any position within the housing interior because the roller assembly freely moves on the assembly tracks. The tube and cap are then positioned and snapped into place by the plastic tangs. The rollers are then activated by the switch in a forward position and the rollers will then compress the tube displacing toothpaste from the tube to the dispensing port. Incremental roller movement and dispensing a small amount of Toothpaste is accomplished by briefly activating the forward roller switch. A clear front panel of the housing allows for inspection of the tube and a means for determining when the tube is empty. When the tube is empty the motorized rollers are switched to reverse and the rollers back down the compressed tube allowing the cap and tube to be removed as a unit by removing the cap.

It is noted that the embodiment of the toothpaste dispensing apparatus described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An apparatus for dispensing toothpaste from a collapsible toothpaste tube, comprising:

a) a tube compressing assembly comprising, a roller frame, a pair of rollers mounted within said frame, each roller further includes knurled frictional tube engagement surfaces providing non-slip advancement of the rollers over a noncompressed tube, the rollers are further mounted on the frame so that the frictional surfaces are separated by a distance which allows passage of a compressed tube thickness between the rollers, a reversible drive motor and drive gearing is mounted on said frame and gearingly coupled to said rollers so that when the drive motor is actuated to a forward direction the motor rotates the rollers in a direction over a noncompressed collapsible tube thereby compressing the collapsible tube and displacing the toothpaste from a collapsible tube open end, and when the motor is actuated to a reverse direction the motor rotates the rollers in a direction over a compressed portion of the tube, b) a housing in the general shape of a rectangle about ten inches tall, three inches long and about two inches wide, said housing further including a top end and a bottom end and two interior cavities, one interior cavity receives the compressing assembly and the other interior cavity relieves wiring and the drive motor, the cavities are connected by a longitudinal aperture extending from the housing top end to the housing bottom end, a power supply compartment is attached to the housing bottom end and forms a housing floor for both interior cavities, the compressing assembly interior cavity has four corners each corner is configured as a track extending from the housing top end to the housing bottom end and further receives the compressing assembly frame which is dimensioned to allow the compressing assembly to freely travel from the housing top end to the housing bottom end along the tracks, the drive motor and drive motor wiring extends from the compressing assembly through the longitudinal aperture when the compression assembly is in place within the compression assembly interior cavity, a dispensing cap is dimensioned to securely attach to the top end of the housing and further provides a means for delivering the toothpaste from the collapsible tube open end to a toothpaste delivery port positioned on the dispensing cap and a means for securing the collapsible tube within the housing, the collapsible tube is attached to the dispensing cap by threads which attach a tube open end threaded portion to a dispensing cap female threaded portion, a toothpaste delivery channel travels from the female threaded portion to a delivery port allowing toothpaste to be delivered to the delivery port when the tube is compressed, the dispensing cap and the attached toothpaste tube are secured in the housing compressing interior cavity with a crimped end of the collapsible tube being placed in the space between the rollers by a pair of plastic locking tangs positioned at the top of the housing which are biased to a locking position, c) a reversible motor actuation switch is mounted to the top of the housing, a power supply comprising a plurality of dry cell batteries is contained in the power supply compartment, and a flexibly means for coupling the power supply to said drive motor, d) and, a means for attaching the apparatus to a wall.

* * * * *